United States Patent [19]

Gurries

[11] 4,330,156

[45] May 18, 1982

[54] RESONANT SYSTEM SPEED CONTROL

[75] Inventor: Raymond A. Gurries, Reno, Nev.

[73] Assignee: Resonant Technology Co., Sparks, Nev.

[21] Appl. No.: 130,508

[22] Filed: Mar. 14, 1980

[51] Int. Cl.[3] ..... A01B 35/00; E01C 23/09

[52] U.S. Cl. ..... 299/37; 172/40; 175/55; 299/14

[58] Field of Search ..... 299/14, 37; 175/55, 175/56; 173/49; 172/40; 37/DIG. 18; 74/61

[56] References Cited

U.S. PATENT DOCUMENTS

| | | | |
|---|---|---|---|
| 2,384,435 | 9/1945 | Bodine | 175/56 X |
| 3,004,389 | 10/1961 | Muller | 175/56 X |
| 3,336,082 | 8/1967 | Bodie | 299/14 |
| 3,367,716 | 2/1968 | Bodine | 299/14 |
| 3,452,830 | 7/1969 | Gendron et al. | 175/55 |
| 3,572,139 | 3/1971 | Shatto et al. | 74/87 |

OTHER PUBLICATIONS

German Invention Disclosure Daim 12 322/4, 12/12/78, 1 sheet drawing, 6 pp. spec.

*Primary Examiner*—Ernest R. Purser

*Attorney, Agent, or Firm*—Townsend and Townsend

[57] ABSTRACT

A resonant work performing apparatus is disclosed which includes a resonant system which is vibratory in resonance at an unloaded resonant frequency. The resonant system has a vibratory input at a frequency near the resonant frequency, and a vibratory output responsive to vibrations at the input. The resonant system has at least one intermediate node, and the apparatus includes a frame attached to the resonant system substantially at the node. A vibrational force is applied to the input of the resonant system at a given frequency near the unloaded resonant frequency to excite the resonant system to at least near resonance. A sensor is used to determine the frequency of the resonant system. Application of the vibrational force is controlled responsively to the sensor to hold the applied vibrational force at the given frequency.

13 Claims, 4 Drawing Figures

RESONANT SYSTEM SPEED CONTROL

BACKGROUND OF THE INVENTION

The present invention relates generally to power driving apparatus and, more particularly, to apparatus for resonantly driving tools of various types to work on earth, coal, wood, concrete, asphalt or other materials or substances.

Various forms of power sources, mechanical, hydraulic, pneumatic or others, are used to drive tools for different purposes, for example, digging coal, cutting trees, driving piles, pavement removal, earth working, and various agricultural operations. The specific tool is designed for the particular job.

Recently, a power source has been developed employing a resonant vibration system driven by an oscillator, an example being shown and described in U.S. Pat. No. 3,367,716. While the resonant vibration principle has merit in that considerable force can be generated, the proper transfer of such force to the material has proved extremely difficult to accomplish.

The principal advantage of a resonant drive system, as described herein, is that the vibrating element can be supported at its nodes, which are basically stationary. As a result, the transfer of the input forces to the resonant system to the frame is minimized.

It has been found that the location of the nodes in a resonant system varies widely with relatively small changes in operating frequency. In use, when the resonant system encounters a load, the frequency of the system will tend to decrease. Any such decrease in frequency moves the location of the effective nodes, and the supporting frame is no longer attached to the resonant system at the nodes. The net result is that the input vibrational forces are transmitted directly to the frame, with potentially catastrophic consequences.

SUMMARY OF THE INVENTION

The present invention relates to resonant work performing apparatus including a resonant system which is vibratory in resonance at an unloaded resonant frequency. The resonant system has a vibratory input at a frequency near the resonant frequency, and a vibratory output responsive to vibrations at the input. The resonant system has at least one intermediate node, and the apparatus includes a frame attached to the resonant system substantially at the node. A vibrational force is applied to the input of the resonant system at a given frequency near the unloaded resonant frequency to excite the resonant system to at least near resonance. A sensor is used to determine the frequency of the resonant system. Application of the vibrational force is controlled responsively to the sensor to hold the applied vibrational force at the given frequency.

By monitoring and controlling the frequency of the resonant system, the frequency of the system is maintained very close to its preferred value. As a result, the node positions will not move, and the frame will thus always support the resonant system at the effective node positions. The transfer of input vibrational forces to the frame will be kept to an absolute minimum, thereby minimizing wear and tear on the frame and the chance of catastrophic failure.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE SPECIFIC EMBODIMENTS

Figure 1:
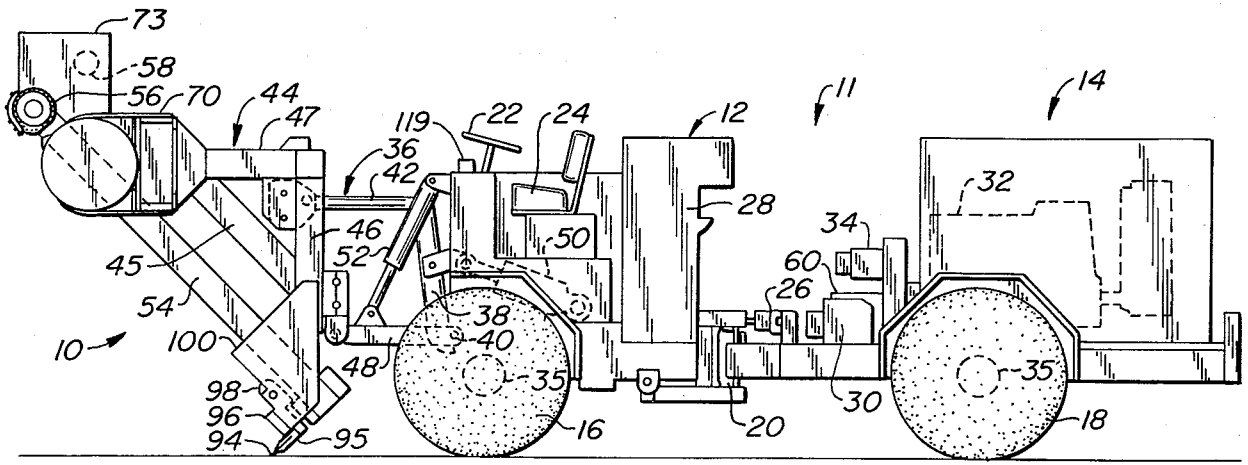
FIG. 1 is a side elevation view of a resonantly driven pavement planer embodying the principles of the invention.
Figure 2:
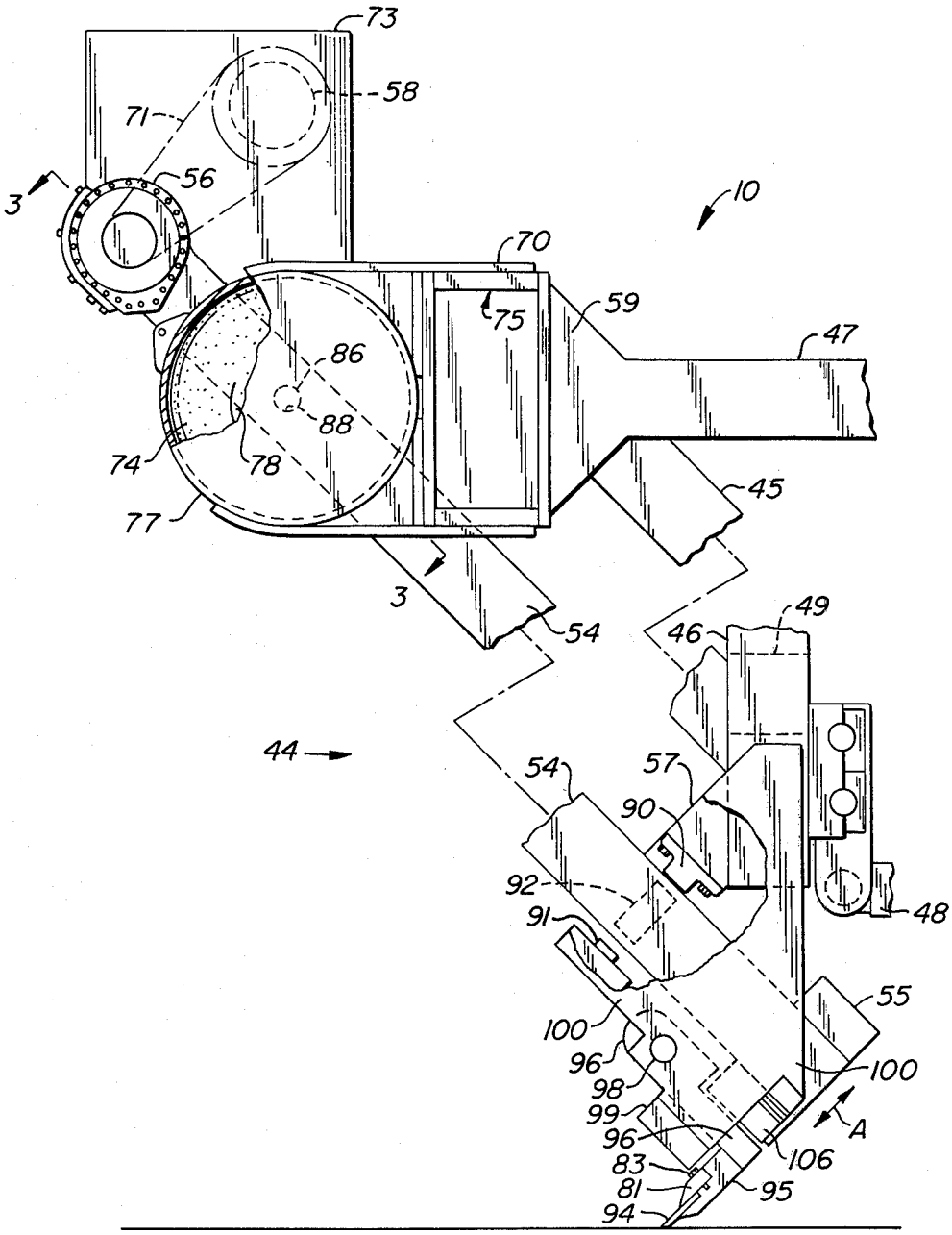
FIG. 2 is a fragmentary enlarged side view of the pavement planer of FIG. 1 with portions broken away to show interior details.
Figure 3:
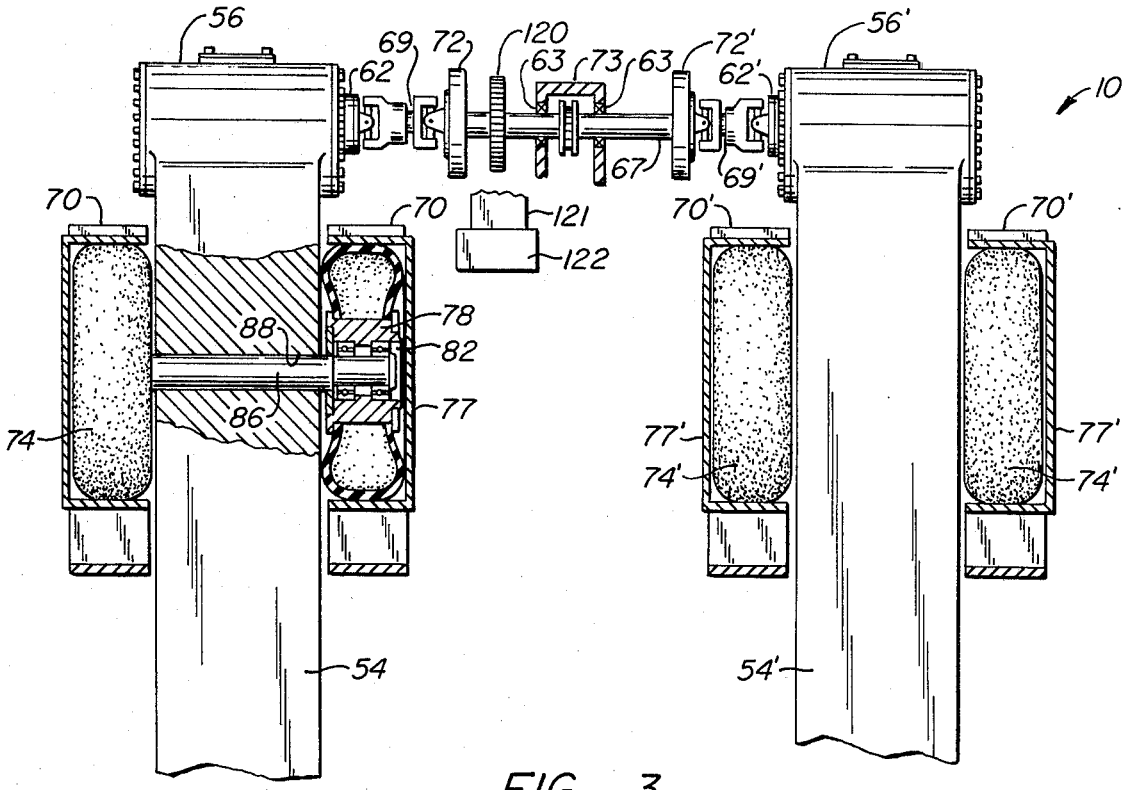
FIG. 3 is a fragmentary cross sectional view of the pavement planer taken along line 3—3 of FIG. 2.

With initial reference to FIGS. 1, 2, and 3, a pavement planer comprises a cutting assembly generally indicated at 10 mounted at the front of a mobile carrier 11, which includes forward and rearward frame sections 12, 14, each supported by two rubber-tired wheels 16 and 18. The two frame sections 12, 14 are connected by a vertical pivot pin 20, which enables articulation of the frame sections for purposes of steering.

A steering wheel 22 is mounted forwardly of a driver's seat 24 on the front section 12 of the frame and is arranged to energize, upon turning, a hydraulic ram 26 pivotally joining the frame sections 12, 14 so as to effect articulation thereof and consequent steering. A manual frequency selector 119 is mounted so that it can be manipulated by the driver. A hydraulic pump 30 is mounted on the rear section 14 of the frame, and driven by an internal combustion engine 32. Fluid from a hydraulic reservoir is driven by pump 34 through suitable hydraulic conduits (not shown) to hydraulic ram 26.

The engine 32 also drives a second hydraulic pump 30 which is hydraulically connected to hydraulic motors 35 to drive wheels 16 on the front frame section 12 and the wheels 18 on the rear frame section 14, thus to provide motive power for the entire mobile carrier 11 in a generally conventional fashion. As will be understood, the motive power delivered to the wheels will urge the front-mounted cutting assembly 10 against material being cut with a certain tractive force which, for cutting a six-foot swath of concrete or asphalt, should vary for example between 5,000 and 60,000 pounds, depending upon the material resistance and vehicle speed. As is well known in the art, the maximum tractive force of the vehicle depends upon the friction between the wheels and the surface on which it moves.

Cutting assembly 10 is symmetrical about a center plane in the direction of movement, i.e., parallel to the plane of FIG. 1. Many of the elements on the right side of the center line, as viewed from the front, i.e., the left in FIG. 1, which are identified by unprimed reference numerals, have counterparts on the left side of the center line, which are identified by the same reference numerals primed.

In order to mount the cutting assembly 10, a pair of laterally-spaced parallelogram units 36, 36' extend forwardly from the forward frame section 12. More particularly, the parallelogram units 36, 36' include an upstanding leg 38, pivotally connected at its lower extremity to the central portion on the front frame section 12 and pivotally joined at its upper extremities to the rear ends of forwardly projecting legs 42, 42'. These forwardly projecting legs 42, 42' are pivotally joined at laterally-spaced positions to a generally triangular cutting assembly frame 44. Lower and outwardly curving legs 48, 48' are pivotally connected at their opposite extremities to the lower ends of the support beams 46, 46' and the previously described shaft 40, thus completing the two parallelogram units 36, 36'.

A powered hydraulic ram 50 is pivotally secured between the forward frame section 12 and the rear upright leg 38 of the parallelogram units 36, 36' to enable powered variation of the parallelogram disposition and accordingly the angular disposition of the cutting assembly 10. Additional powered hydraulic rams 52, 52' pivotally joined to the top of the frame section 12 and the lower generally horizontal legs 48, 48' of the parallelogram units 36, 36' enable substantially vertical adjustment of the cutting assembly.

The cutting assembly frame 44 supports a resonant system in the form of a pair of matched, i.e., identical straight resonant beams 54, 54' composed of solid steel or other elastic material. Beams 54, 54' comprise a distributed mass-spring system. Resonant beams 54, 54' are substantially parallel to struts 45, 45'. Synchronized eccentric weight oscillators 56, 56' are coupled to the upper end of each resonant beam. The housings of oscillators 56, 56' are preferably formed in a one piece construction with the upper end of resonant beams 54, 54'. Oscillators 56, 56' are driven by a suitable hydraulic motor 58, that is energized through suitable hydraulic conduits (not shown) from a third hydraulic pump 60. Pump 60 is driven by engine 32. Pairs of weights 55, 55' are attached for example, by bolting, to the front and back of resonant beams 54, 54' at the lower end to form a hammer that increases the momentum thereof.

As shown in FIG. 3, a drive shaft 67 is coupled by pairs of tandemly connected universal joints 69, 69' to shafts 62, 62'. Drive shaft 67 is supported by bearings 63, 63' mounted in the sidewalls of a protective housing 73, through which drive shaft 67 passes. Power transmission means 71 such as a belt, chain or gear train inside housing 73 couples hydraulic motor 58 to drive shaft 67. Lubricating oil is sprayed in a housing 73 by means (not shown) onto power transmission means 71 and bearings 63, 63'. Seals (not shown) outside of bearings 63, 63' prevent the oil spray from leaving housing 73. Motor 58 is attached, for example, by bolting, to the outside of housing 73. Fly wheels 72, 72' are mounted on shaft 67 outside housing 73 for the purpose of isolating motor 58 and power transmission means 71 from periodic forces exerted by oscillators 56, 56'. Housing 73 is stationary so drive shaft 67 only rotates. Resonant beams 54, 54' vibrate. Tandemly connected pairs of universal joints 69, 69' permit shafts 62, 62' to vibrate with beams 54, 54' as they are rotatably driven by drive shaft 67.

Each beam is carried from the cutting assembly frame 44 at its upper node position. However, the connection is resilient to accommodate vibration during operation. Specifically, as illustrated in FIGS. 2 and 3, pairs of rectangular brackets 75, 75' are attached, for example by welding, to the side of flared bracket mounts 59, 59'. Pairs of annular resilient members 74, 74' in the form of pneumatic rubber tires are located inside pairs of cylindrical housings 77, 77'. Housing pairs 77, 77' are held on opposite sides of resonant beams 54, 54' by pairs of connecting arms 70, 70' attached, for example by bolting, to bracket pairs 75, 75'. Pairs of annular resilient members 74, 74' are mounted on pairs of central hubs 78, 78'. Shafts 86, 86' are press fitted into bores 88, 88' in resonant beams 54, 54' at their upper node positions. Hub pairs 78, 78' are mounted for rotation on the ends of shafts 86, 86' by pairs of bearings 82, 82'. Thus, resonant beams 54, 54' are supported by shafts 86, 86' are pivotable about their axes by virtue of bearing pairs 82, 82'. In the manner of a spring, the described pneumatic tires, which serve as upper node supports for resonant beams 54, 54', accommodate the vibration resulting from loading of the resonant beams, when the cutter blade described below is in engagement with a material to be cut, sheared, or planed, and the internal tire pressure can be changed as required to control the spring constant.

Resonant beams 54, 54' each have a fundamental free-free resonant standing wave node at a frequency called herein its unloaded resonant frequency near which the beams each have a vibratory input at their upper end, and output at their lower end, which is vibratory in first and second opposite directions represented by an arrow A in FIG. 2 responsive to vibrations at the input, and a pair of nodes spaced apart between the input and the output. For a steel beam weighing about 5000 lbs. including oscillator and hammer, the oscillator providing an eccentric force of 50,000 lbs. with a modulus of elasticity of 30 million, a length of 11 feet, a width of 14 inches, and a thickness of 8 inches, the unloaded resonant frequency is approximately 86 Hz. The nearer the frequency of the applied vibrational force is to the unloaded resonant frequency the larger is the vibrational amplitude of the resonant system for a given input vibrational force. The vibrational amplitude of the resonant system is however limited by the maximum allowable stress that may be exerted thereon, and the system is typically operated at slightly less than its resonant frequency. In the case of a resonant beam having the specified characteristics, a preferred operating frequency would be 75 Hz, at which the peak-to-peak amplitude at the output of each resonant beam is approximately $\frac{1}{2}$ inch. Thus, motor 58 is controlled so as to drive the eccentric weights of oscillators 56, 56' at an annular velocity that produces vibrational force at 75 cycles per second, namely, at an annular velocity of approximately 465 radians per second. For the specified resonant beam, an operating frequency of 77 cps produces output vibrations having a peak-to-peak amplitude of approximately $\frac{3}{4}$ inches and an operating frequency of 73 cps produces output vibrations having a peak-to-peak amplitude of approximately $\frac{1}{4}$ inch.

As shown in FIG. 2, at the lower node position, resonant beams 54, 54' are encompassed by rigid metal stop members 90, 90' at their rear, resilient rubber pads 91, 91' at their front, and pairs of resilient rubber pads 92, 92' at their sides. Pad pairs 92, 92' and pads 91, 91' comprise pieces of rubber vulcanized on metal mounting plates. Members 90, 90', pads 91, 91' and pad pairs 92, 92' are secured to the lower end of cutting assembly frame 44. When resonant beams 54, 54' are at rest, they lie on and are supported by pads 91, 91'. When resonant beams 54, 54' are vibrating during operation of the apparatus, their lower node is driven against stop members 90, 90' by the reaction of the material being worked upon as shown in FIG. 2, and remain in abutment with stop members 90, 90' during operation of the apparatus.

Thus, stop members 90, 90' serve as rigid node supports for resonant beams 54, 54'. Stop members 90, 90' and pads 91, 91' are spaced sufficiently far apart to enable resonant beams 54, 54' to be shimmed to synchronize their transfer of force to the work tool. Specifically, shims (not shown) are inserted between stop members 90, 90' and stop mounts 57, 57' so the lower ends of resonant beams 54, 54' in their neutral position are both spaced precisely the same distance from the lever arms and cutter blade described below. Consequently, since oscillators 56, 56' run in phase and resonant beams 54, 54' reciprocate in phase, the lower ends of resonant beams 54, 54' strike the cutter blade at the same time, i.e., in synchronism.

As shown in FIG. 2, the cutting assembly 10 includes a work tool which takes the form of an angularly-directed and transversely-extending cutter blade 94 held in a blade base 95. Cutter blade 94 and blade base 95 extend along the full width of the apparatus between beams 54, 54'. Cutter blade 94 is clamped to blade base 95 by a retaining bar 81 that is attached to blade base 95 by bolts 83. Lever arms 96, 96' are attached, for example by welding, near the ends of blade base 95 near beams 54, 54'. Thus, the cutter blade assembly comprising cutter blade 94, blade base 95, retaining bar 81, and lever arms 96, 96' is pivotally supported by brackets 100, 100' so it is adjacent to the lower end of the resonant beams 54, 54'. When the beams vibrate, they drive the cutter blade assembly in a forward and downward direction or to the left, as shown in FIG. 2, and thereafter withdraw from contact with the cutter blade assembly in its cyclical displacement in the opposite or rearward direction. Thus, only unidirectional driving impulses are delivered to the cutter blade assembly in its forward direction, and in alignment with its cutting direction, so the cutter blade 94 advances with a chisel-like action.

Cutter blade 94 comprises a work tool that moves along the road surface, which comprises the work path. Cutting assembly frame 44 functions as a tool holder or carrier on which the tool is mounted for reciprocation parallel to the beam outputs. Unidirectional force is applied thereto by mobile carrier 11 in a direction parallel to the work path. Oscillators 56, 56' generate a vibrational force, at least one component of which acts parallel to the work path. Each resonant beam 54, 54' comprises a force transmitting member, its upper end comprising an input to which the vibrational oscillator force is applied, and its lower end comprising an output from which the vibrational force is transferred to the tool. The tool advances intermittently along the work path responsive to the force applied by oscillators 56 and 56'.

When the beams 54, 54' withdraw from contact with the cutter blade 94 during resonant vibration, a momentary gap is formed which will remain until a repeated forward motion of the beams 54, 54'. To maximize the cutting force, it has been found that contact of the beams with the cutter blade preferably is made in the region where maximum velocity (and momentum) of the beams is approached in the forward (cutting) direction. Since the cutter blade 94 is in engagement with material to be cut, the adjacent beam is urged forwardly relative thereto, thus to close the momentary gap at the appropriate time of the resonant cycle.

Figure 4:
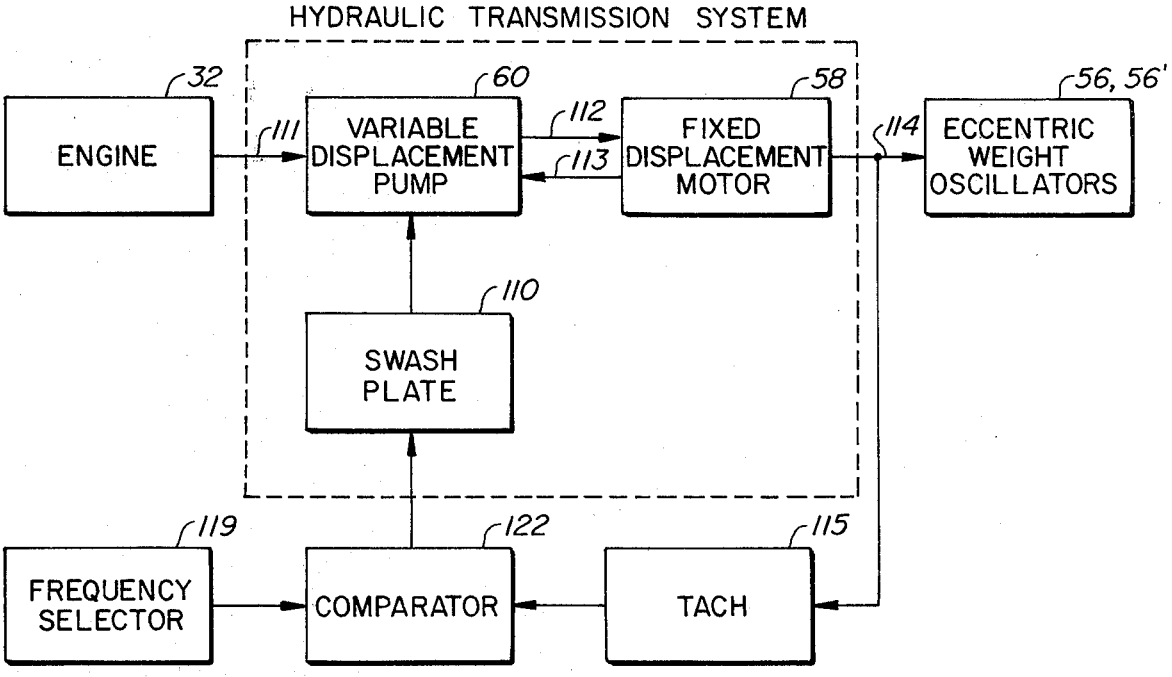
FIG. 4 is a schematic diagram of the system for driving the oscillator of the pavement planer.

The present invention provides a control system for maintaining the frequency of the vibrations applied to the input of the resonant system at a predetermined, preferably constant value. In FIG. 4, engine 32, oscillator 56, motor 58, and pump 60 are represented in schematic block form. Pump 60 is preferably a variable displacement axial piston pump having a swash plate 110, the angular position of which determines the displacement of pump 60. The drive shaft of engine 32 is connected to the input shaft of pump 60 as represented by a line 111. Fluid supply and return lines 112 and 113, respectively, are connected between pump 60 and motor 58, which is preferably a fixed displacement axial piston motor. The output shaft of motor 58 is connected to shafts 62, 62' of oscillators 56, 56' as represented by a line 114 in the manner described above in connection with FIG. 3.

A tachometer (TACH) 115 is coupled to the connection between motor 58 and oscillators 56, 56'. Specifically, as shown in FIG. 3, tachometer 115 could comprise a gear 120 mounted on shaft 67, and a pickoff coil 121. Pickoff coil 121 is located in close proximity to the teeth on gear 120 and is oriented so as to produce a pulse as each tooth passes by.

The pulses produced by pickoff coil 121 are fed to a comparator 122. Comparator 122 also receives an input from frequency selector 119, which the driver of the machine uses to preset the desired frequency. Comparator 122 compares the frequency indicated by the output of tachometer 115 with a preselected frequency from selector 119. If a variation is observed, comparator 122 adjusts swash plate 110 accordingly so that the frequency returns to its preselected value.

The location of the node of the resonant system is dependent upon its operational frequency, i.e., its actual frequency of vibration. The described control system senses changes in the frequency of vibration and adjusts swash plate 110 to nullify such changes and accordingly nullifies changes in node location. When the output of the resonant system encounters an excessive load, its vibrational amplitude and frequency tend to drop, assuming the predetermined frequency is on the lower side of the resonant curve, i.e., below peak resonance, as required for stable operation. The decrease in actual vibrational frequency is sensed by tachometer 115 and swash plate 110 adjusts pump 60 to draw more power from engine 32 and maintain motor 58 at the predetermined constant frequency. Thus, more power is supplied by engine 32 to meet the excessive load and prevent movement of the node positions which would otherwise result. Pump 60 is sized to provide sufficient fluid displacement to maintain the operating frequency at the predetermined constant value over the entire range of an anticipated engine speed.

Even if the frame on which the resonant system is mounted is not movable, the operating frequency of the resonant system tends to drop as the load increases. Accordingly, the described control system is generally useful in circumstances where the output of the resonant system encounters a variable load, whether or not the resonant system is mounted on a movable frame and whether or not an excessive load is encountered. As the load conditions vary, the operating frequency of the resonant system is held constant by the control system, thereby maintaining the positions of the nodes. Absent the described control, the location of the nodes would vary greatly under varying load conditions.

Other types of transmission systems could also be employed. In the case of the described hydraulic transmission system, the drop in frequency with increasing load is attributable to the fact that the pump pressure rises with increasing load, thereby increasing the volumetric fluid loss, which reduces the speed of motor 58 for a given adjustment of swash plate 110. In other words, the ratio of output speed to input speed of the described hydraulic transmission system varies as a function of the output load of the resonant system, such ratio decreasing as the load increases.

The described embodiment of the invention is only considered to be preferred and illustrative of the inventive concept; the scope of the invention is not to be restricted to such embodiments. Various and numerous other arrangements may be devised by one skilled in the art without departing from the spirit and scope of this invention. For example, although the invention is illustrated in specific machines, it could be incorporated into any number of material working machines such as a coal planer, a timber shearer, a bulldozer, a front-end loader, or a shovel bucket. In general, the invention is applicable to any type of material working function wherein at least a portion of a resonant system supporting frame is advanced through the material to perform the desired work. The control system of FIG. 4, however, is also applicable to function where the resonant system supporting frame is entirely stationary to maintain a constant or controlled vibrational amplitude. The invention can be practiced with other types of resonant systems including resonant beams of other configurations. Although it is preferable to practice the invention in apparatus employing "sonic rectification" as that term is used in Bodine U.S. Pat. No. 3,367,716, the invention is also applicable to apparatus in which the tool is attached to the force transmitting member, e.g., the resonant beams, as in Bodine U.S. Pat. No. 3,232,669.

What is claimed is:

1. Resonant work performing apparatus comprising:

a resonant system having a vibratory input, an output vibratory in first and second opposite directions responsive to vibrations at the input, and at least one intermediate node;

a frame attached to the resonant system substantially at the node;

means for applying a vibrational force to the input of the resonant system at a given frequency near the unloaded resonant frequency to excite the resonant system to at least near resonance;

means for sensing the frequency of the resonant system; and means responsive to said sensing means for controlling the applying means to hold the applied vibrational force at the given frequency to prevent movement of the node positions.

2. The apparatus of claim 1, wherein said applying means comprises an eccentric weight oscillator coupled to the input of the resonant system.

3. The apparatus of claim 2 wherein said applying means further comprises a hydraulic motor which powers the eccentric weight oscillator, and wherein the controlling means comprises means for controlling the flow of hydraulic fluid to the hydraulic motor to hold the applied vibrational force at the given frequency.

4. The apparatus of claim 1 wherein the sensing means senses the frequency of the applied vibrational force to determine the frequency of the resonant system.

5. The apparatus of claim 1, in which the resonant system is a distributed mass-spring system.

6. The apparatus of claim 5, in which the distributed mass-spring system is a straight beam resonant in a free-free mode, the input being at one end of the beam, the output being at the other end of the beam, and two intermediate nodes between the ends of the beam.

7. The apparatus of claim 5, in which the distributed mass-spring system is an angulated beam having first and second legs extending from a juncture, the input is at the end of one leg,the output is at the end of the other leg, and the node is at the juncture.

8. The apparatus of claim 1, additionally comprising a tool and means for mounting the tool on the frame for reciprocation in the first and second directions in the path of the output of the resonant system.

9. Resonant driving apparatus comprising:

a resonant system with an input, an output, and at least one intermediate node;

an eccentric weight oscillator coupled to the input to apply vibrations thereto;

means for rotatably driving the eccentric weight oscillator near the unloaded resonant frequency;

means for sensing the frequency at which the resonant system is vibrating; and means responsive to the sensing means for controlling the driving means to hold the frequency at which the resonant system vibrates at a predetermined value to prevent movement of the position of the node.

10. The apparatus of claim 9, in which the driving means comprises a prime mover, a variable displacement hydraulic pump driven by the prime mover, and a hydraulic motor driven by the pump; and the controlling means comprises a displacement changing swash plate in the pump.

11. The apparatus of claim 10, in which the motor has an output shaft connected to the oscillator and the sensing means is a tachometer directly coupled to the output shaft.

12. The apparatus of claim 9, in which the controlling means comprises means for controlling the driving means to hold constant the frequency at which the resonant system vibrates.

13. An apparatus mounted in a frame for resonantly driving a tool, said apparatus comprising:

at least one resonant member having an input, an output, and at least one intermediate node;

means for mounting the resonant member to the frame substantially at the intermediate node;

means mounted on the resonant member for vibrating the input thereof at a given frequency near the resonant frequency of the member;

means for sensing the actual frequency in which the resonant member is vibrating; and means responsive to the sensing means for controlling the vibrating means to hold the frequency at which the resonant member vibrates at said predetermined value to prevent movement of the position of the node.

* * * * *